US010720732B2

(12) United States Patent
Zhao

(10) Patent No.: US 10,720,732 B2
(45) Date of Patent: Jul. 21, 2020

(54) ELECTRICAL CONNECTOR HAVING UPPER AND LOWER POWER CONTACTS STAMPED TO CONTACT EACH OTHER

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Jun Zhao, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/257,001

(22) Filed: Jan. 24, 2019

(65) Prior Publication Data

US 2019/0252830 A1 Aug. 15, 2019

(30) Foreign Application Priority Data

Feb. 9, 2018 (CN) ..... 2018 1 0133216

(51) Int. Cl.
*H01R 43/00* (2006.01)
*H01R 13/6585* (2011.01)
(Continued)

(52) U.S. Cl.
CPC ..... *H01R 13/6585* (2013.01); *H01R 12/725* (2013.01); *H01R 13/642* (2013.01);
(Continued)

(58) Field of Classification Search
CPC ..... H01R 13/6585; H01R 13/642; H01R 13/6594; H01R 13/6582; H01R 12/725; H01R 24/60; H01R 43/24; H01R 43/16; H01R 2107/00; Y10T 29/49204; Y10T 29/49208; Y10T 29/4922; Y10T 29/49222
(Continued)

(56) References Cited

U.S. PATENT DOCUMENTS 9,484,679 B2 11/2016 Guo
9,667,001 B2 * 5/2017 Zhao ..... H01R 13/6581
(Continued)

*Primary Examiner* — Donghai D Nguyen
(74) *Attorney, Agent, or Firm* — Wei Te Chung; Ming Chieh Chang

(57) ABSTRACT

A method of making an electrical connector includes: forming an upper row of contacts each connected between a primary carrier strip and a secondary carrier strip and stamping a selected one of the upper contacts to have a front extension thereof leveled at a lowest position; insert-molding the upper row of contacts with an upper insulator to form an upper terminal module unit; forming a lower row of contacts each connected between another primary carrier strip and another secondary carrier strip and stamping a selected one of the lower contacts to have a front extension thereof leveled at a highest position; insert-molding the lower row of contacts with a lower insulator to form a lower terminal module unit; bringing the front extensions of the selected upper and lower contacts to be in touch with each other. The primary and secondary carrier strips are then severed and an over-mold applied.

20 Claims, 12 Drawing Sheets

(51) Int. Cl.

| | |
|---|---|
| ***H01R 12/72*** | (2011.01) |
| ***H01R 13/6582*** | (2011.01) |
| ***H01R 43/16*** | (2006.01) |
| ***H01R 43/24*** | (2006.01) |
| ***H01R 13/6594*** | (2011.01) |
| ***H01R 13/642*** | (2006.01) |
| ***H01R 24/60*** | (2011.01) |
| *H01R 107/00* | (2006.01) |

(52) U.S. Cl.
CPC ..... *H01R 13/6582* (2013.01); *H01R 13/6594* (2013.01); *H01R 24/60* (2013.01); *H01R 43/16* (2013.01); *H01R 43/24* (2013.01); *H01R 2107/00* (2013.01)

(58) Field of Classification Search
USPC ..... 29/874, 876, 883, 884
See application file for complete search history.

(56) References Cited

U.S. PATENT DOCUMENTS

| | | | | |
|---|---|---|---|---|
| 9,960,543 | B2 * | 5/2018 | Chen | H01R 13/5045 |
| 2016/0099526 | A1 | 4/2016 | Chen | |

* cited by examiner

ELECTRICAL CONNECTOR HAVING UPPER AND LOWER POWER CONTACTS STAMPED TO CONTACT EACH OTHER

BACKGROUND OF THE INVENTION

1. Field of the Invention

The present invention relates to a method of making an electrical connector that includes two rows of contacts connected between a respective primary carrier strip and a respective secondary carrier strip during insert-molding contact module units thereof, wherein selected upper and lower contacts are processed to be in contact with each other reliably.

2. Description of Related Arts

U.S. Pat. No. 9,484,679 discloses an electrical connector, including: an insulative housing having a base and a tongue; and an upper and a lower rows of contacts secured to the insulative housing and exposed respectively to an upper and a lower faces of the tongue, each row of contacts including a ground contact and a power contact, each of the ground contacts and the power contacts having an extension at a front end thereof, wherein the extension of the upper ground contact and/or power contact directly abuts the extension of the lower ground contact and/or power contact in a vertical direction.

U.S. Patent Application Publication No. 2016/0099526 discloses a method of manufacturing an electrical connector, including a step of fixedly connecting an upper power terminal and a lower power terminal by riveting.

SUMMARY OF THE INVENTION

A method of making an electrical connector, comprises the steps of: forming an upper row of contacts each connected between a primary carrier strip and a secondary carrier strip and stamping a selected one of the upper contacts to have a front extension thereof leveled at a lowest position; insert-molding the upper row of contacts with an upper insulator to form an upper terminal module unit; forming a lower row of contacts each connected between another primary carrier strip and another secondary carrier strip and stamping a selected one of the lower contacts to have a front extension thereof leveled at a highest position; insert-molding the lower row of contacts with a lower insulator to form a lower terminal module unit; bringing the front extensions of the selected upper and lower contacts to be in touch with each other; severing the primary and secondary carrier strips connected with the upper row of contacts and the primary and secondary carrier strips connected with the lower row of contacts; and over-molding the upper terminal module unit and the lower terminal module unit with an over-mold.

DETAILED DESCRIPTION OF THE PREFERRED EMBODIMENT

Figure 1:
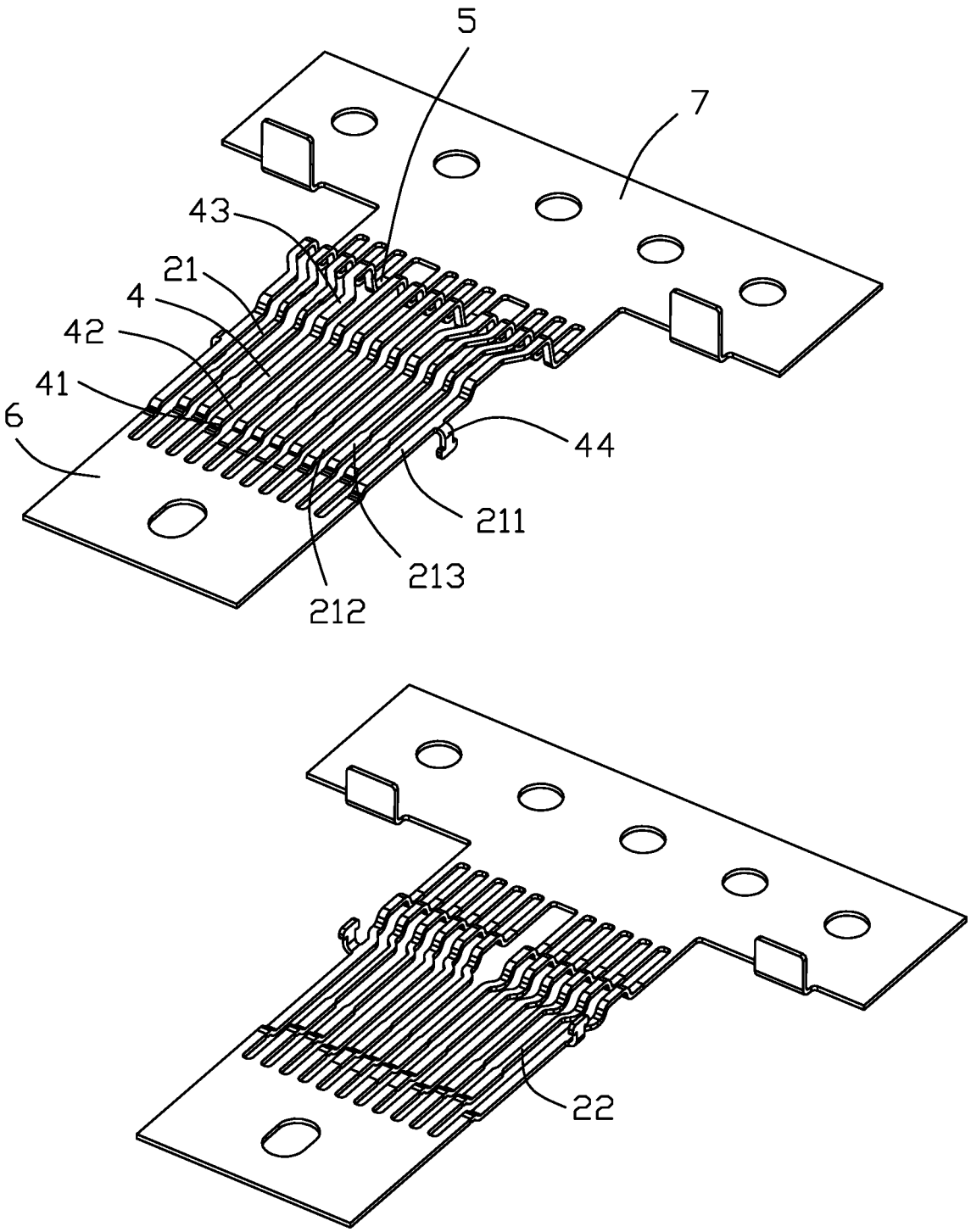
FIG. 1 is a perspective view of two contact rows for making an electrical connector in accordance with the present invention, each row of contacts being shown connected between a respective primary carrier strip and a respective secondary carrier strip.
Figure 2:
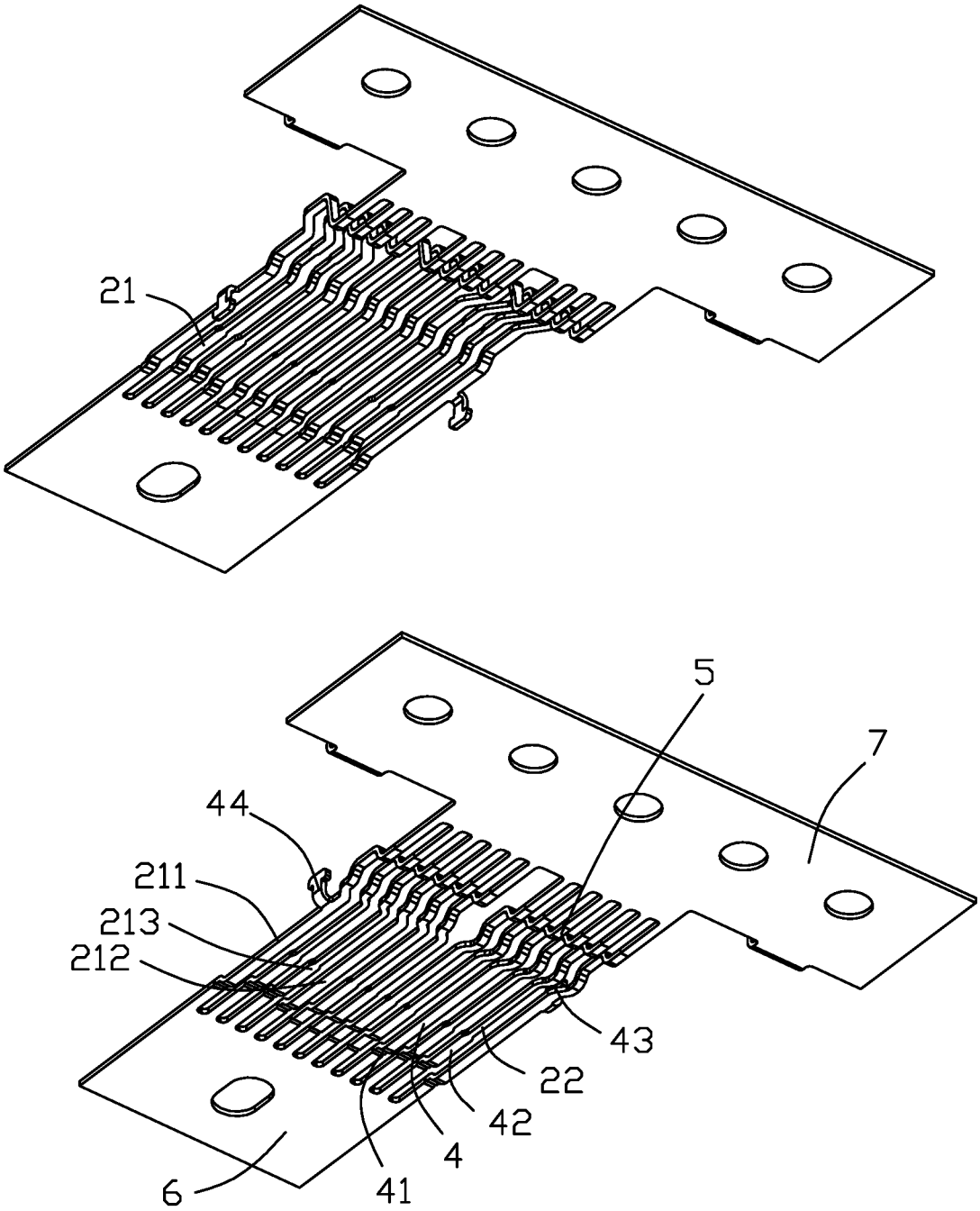
FIG. 2 is a view similar to FIG. 1 but from another perspective.
Figure 3:
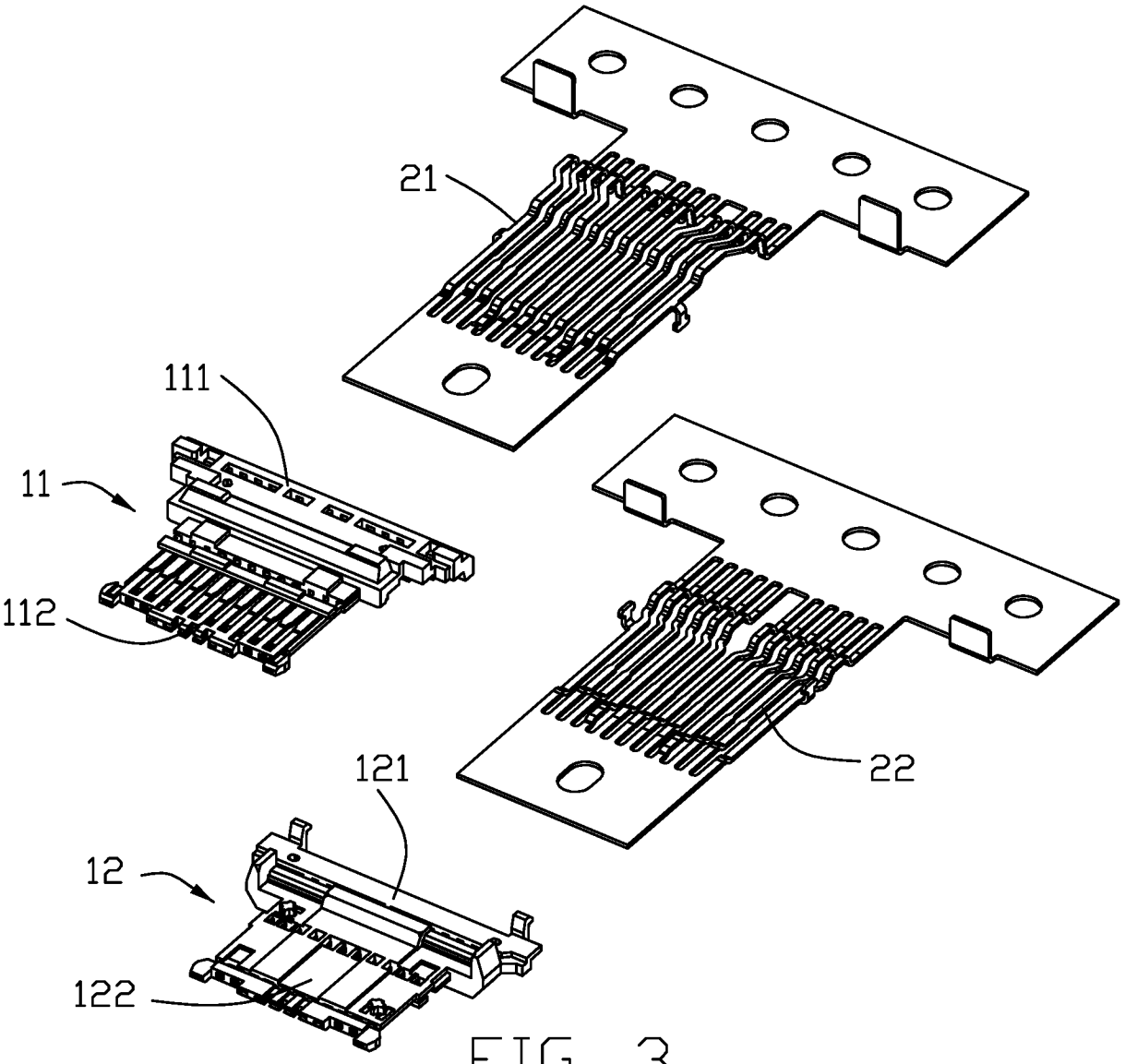
FIG. 3 is a view similar to FIG. 1 further showing corresponding insulators.
Figure 4:
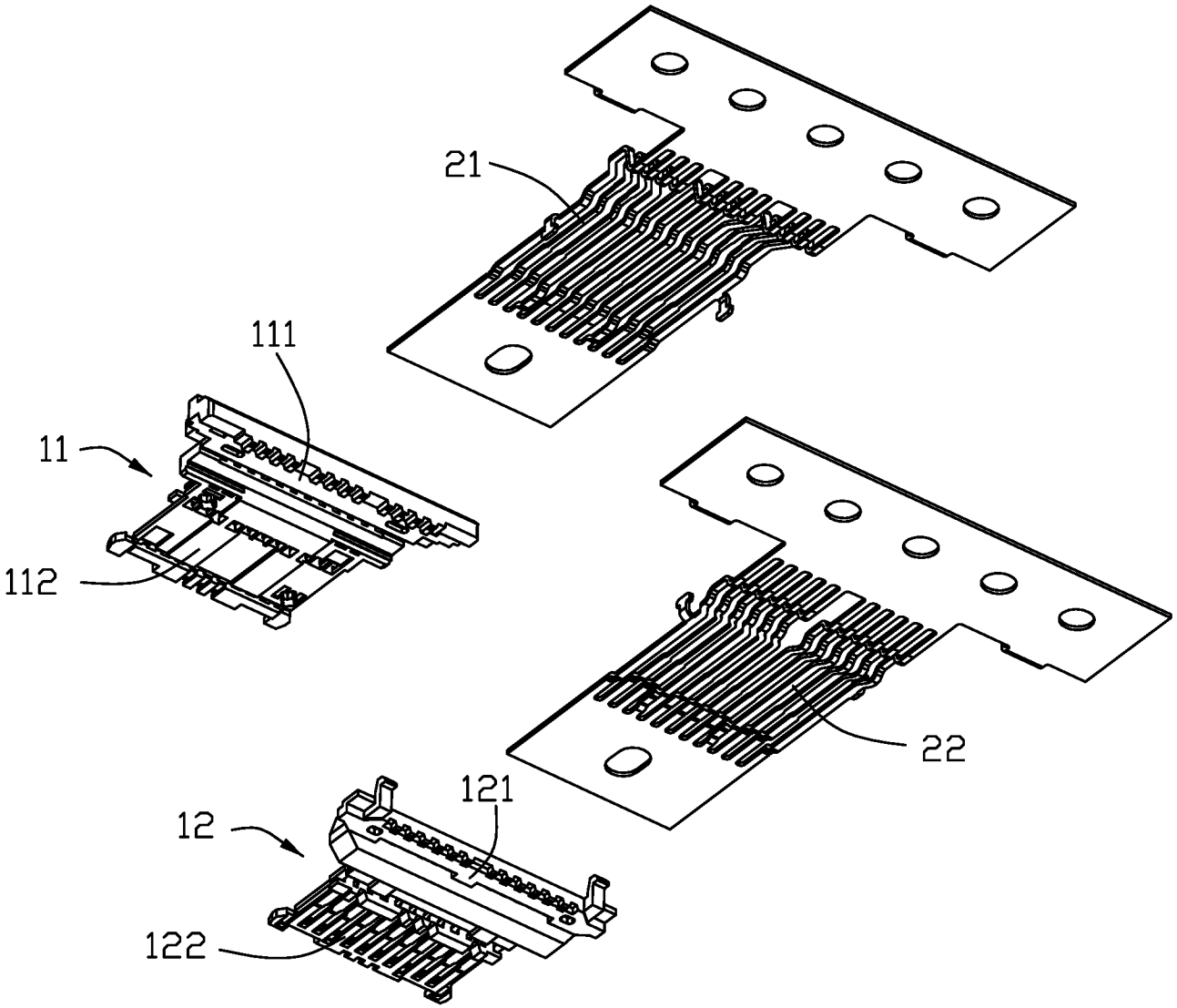
FIG. 4 is a view similar to FIG. 3 but from another perspective.

Referring to FIGS. 1-12, an electrical connector 100 made in accordance with the present invention comprises an insulative housing 1 and an upper row of contacts 21 and a lower row of contacts 22. The electrical connector 100 may further comprise a middle shielding plate 3 between the upper row of contacts 21 and the lower row of contacts 22.

Referring to FIGS. 3-10, the insulative housing 1 is constructed of an upper insulator 11 insert-molded with the upper contacts 21, a lower insulator 12 insert-molded with the lower contacts 22, and an over-mold 13. The insulative housing 1 has a base 14 and a tongue 15 for exposing contacting portions of the contacts 2 in a well-known manner. The upper insulator 11 includes a base 111 and a tongue 112. The lower insulator 12 includes a base 121 and a tongue 122. The over-mold 13 includes a base 131 and a tongue 132. The bases 111/121/131 constitute an overall base 14 of the insulative housing 2; the tongues 112/122/132 constitute an overall tongue 15 of the insulative housing 2.

Contacts 2 in the upper and lower rows are generally arranged in a way to allow dual-orientation mating, as is well known in this art.

Referring to FIGS. 1-4, each row of contacts include two outermost ground contacts 211, a respective pair of high-speed signal contacts 213 next to each of the two ground contacts, a respective power contact 212 inwardly of and next to each pair of high-speed signal contacts, and other contacts. During manufacturing, each contact includes a main portion 4 having a front extension 41 and a rear soldering portion 5, and a primary carrier strip 7 is connected to the soldering portion 5 and a secondary carrier strip 6 is connected to the extension 41. It is noted that between adjacent contacts there is no bridging portions (to be cut off eventually) The main portion 4 includes a contacting portion 42 and a securing portion 43. The ground contact 211 has a side latch 44.

Figure 5:
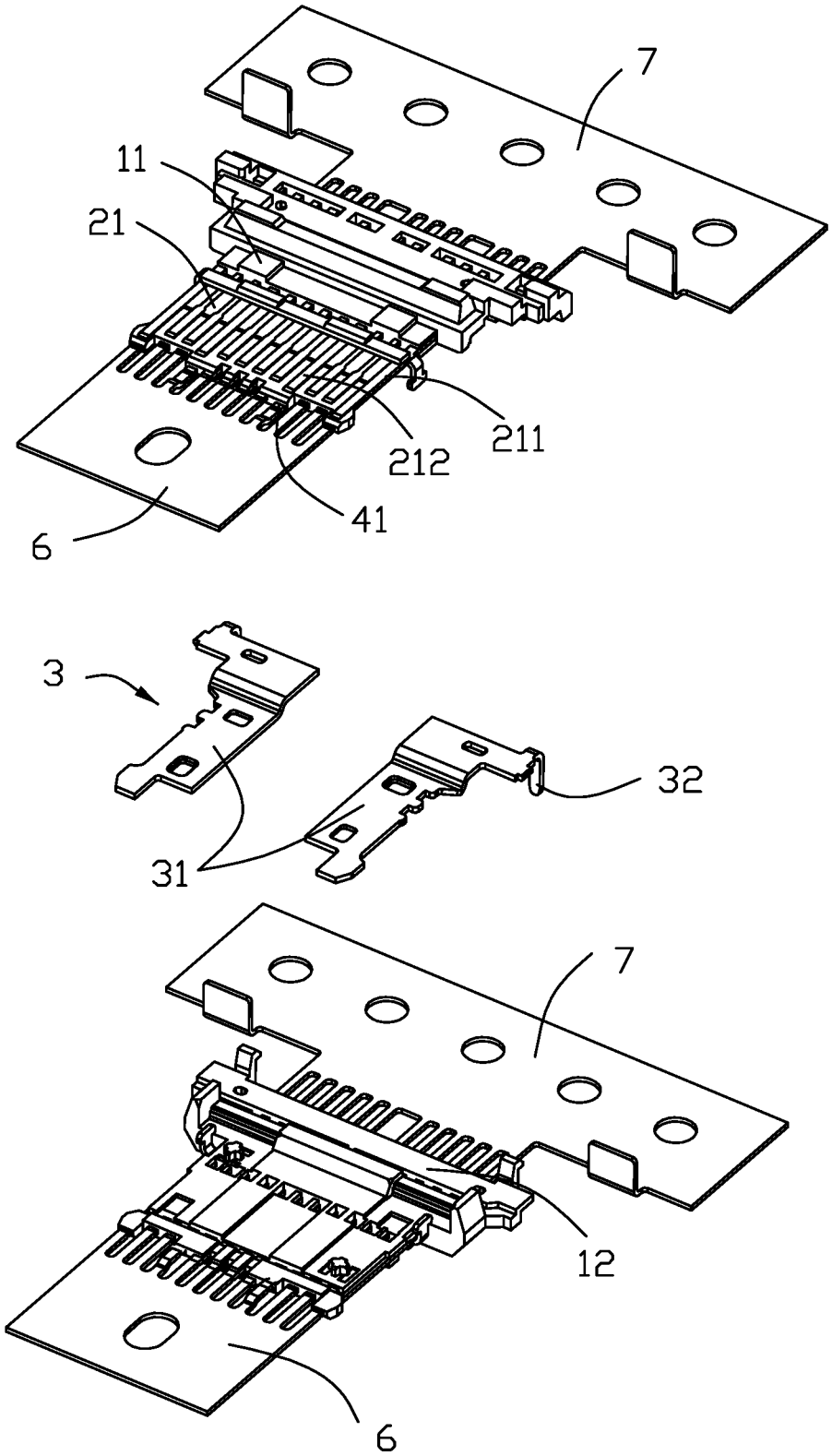
FIG. 5 is a view similar to FIG. 3 further showing respective contact rows insert molded with respective insulators and a middle shielding plate.
Figure 6:
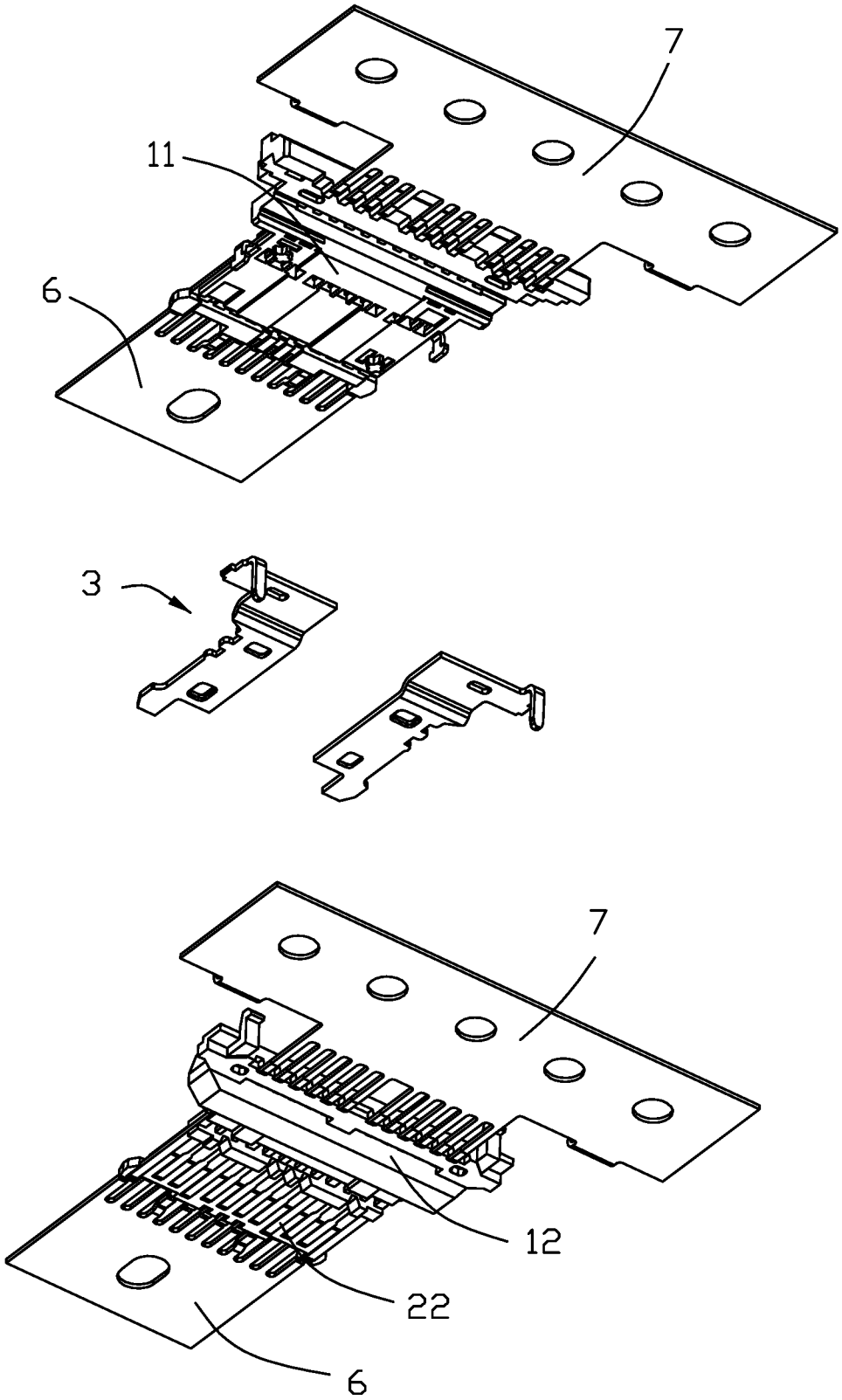
FIG. 6 is a view similar to FIG. 5 but from another perspective.

Referring to FIG. 5, the shielding plate 3 includes a pair of separate pieces and each piece has a main portion 31 and a grounding leg 32.

Referring to FIGS. 1-11, the electrical connector 100 is made by the following steps:

forming an upper row of contacts 21 each connected between a primary carrier strip 7 and a secondary carrier strip 6 and stamping a selected one (the upper power contact 212 in this embodiment) of the upper contacts to have a front extension 41 thereof leveled at a lowest position;

insert-molding the upper row of contacts 21 with an upper insulator 11 to form an upper terminal module unit;

forming a lower row of contacts 22 each connected between another primary carrier strip 7 and another secondary carrier strip 6 and stamping a selected one (the lower power contact 212 in this embodiment) of the lower contacts to have a front extension 41 thereof leveled at a highest position;

insert-molding the lower row of contacts with a lower insulator 12 to form a lower terminal module unit;

bringing the front extensions of the selected upper and lower contacts to be in touch with each other;

severing the primary and secondary carrier strips connected with the upper row of contacts and the primary and secondary carrier strips connected with the lower row of contacts; and over-molding the upper terminal module unit and the lower terminal module unit with an over-mold 13.

In prior art designs involving two carrier strips connected at two ends of a row of contacts, in contrast to one carrier strip connected at one end and plural cut-off bridges between adjacent contacts, it is difficult to bring one contact (e.g., power contact) in the upper row to be in touch with another aligned contact (e.g., power contact) in the lower row. With a step of stamping the front extensions of these two selected contacts (e.g., power contacts) in a unique way, it is assured that the front extensions contact each other when brought together.

Figure 7:
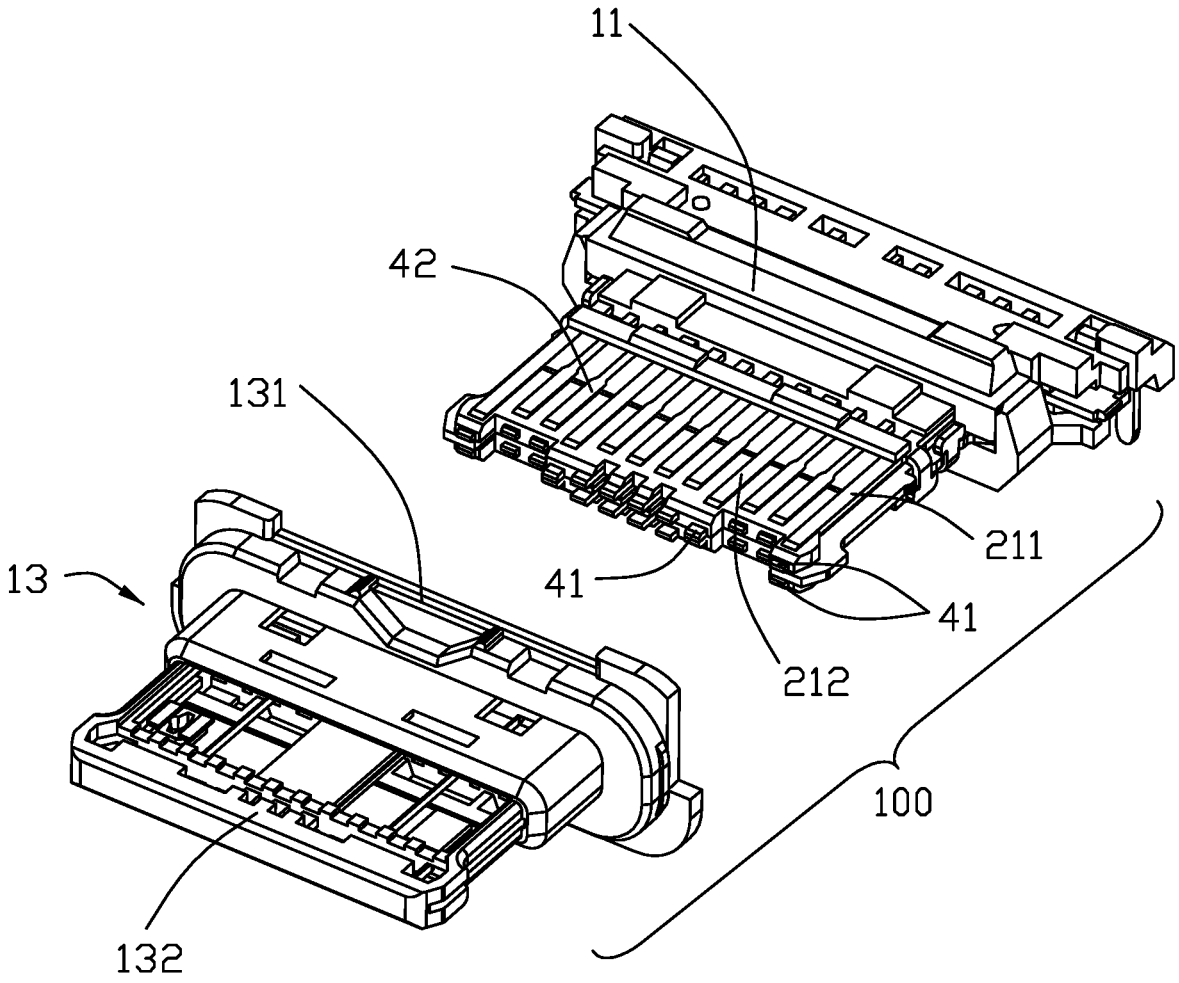
FIG. 7 is a view showing two contact module units are brought together and further showing an over-mold.
Figure 8:
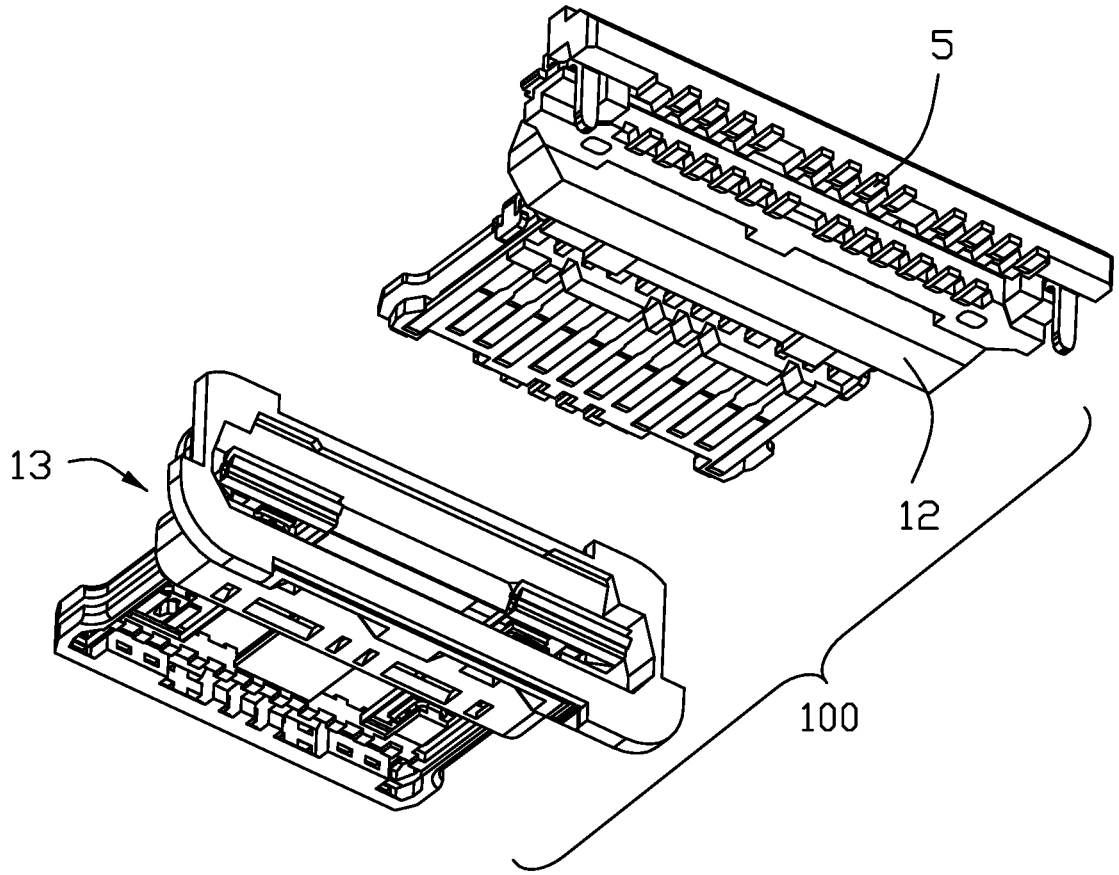
FIG. 8 is a view similar to FIG. 7 but from another perspective.
Figure 9:
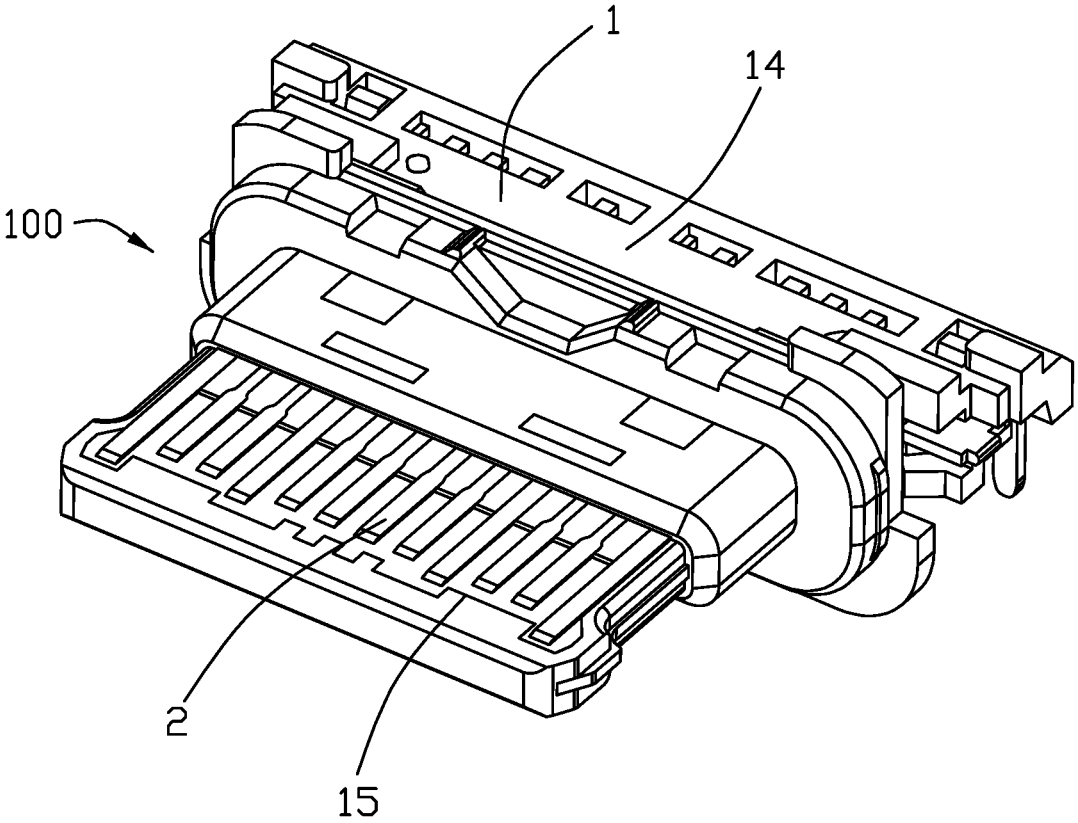
FIG. 9 shows the over-mold is over-molded to the two contact module units.
Figure 10:
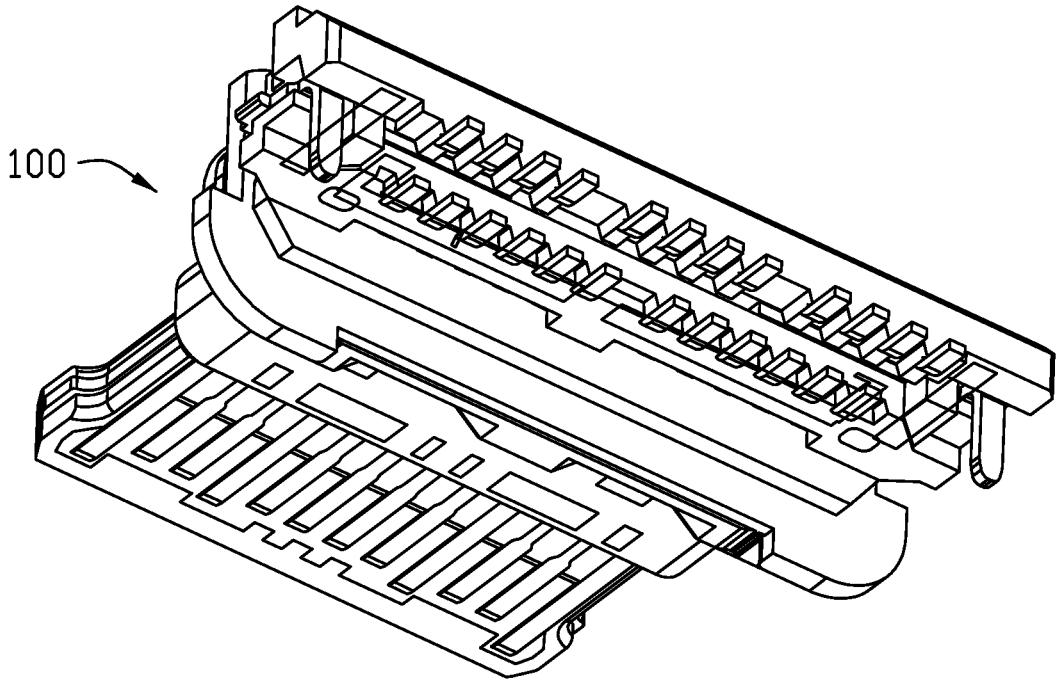
FIG. 10 is a view similar to FIG. 9 but from another perspective.
Figure 11:
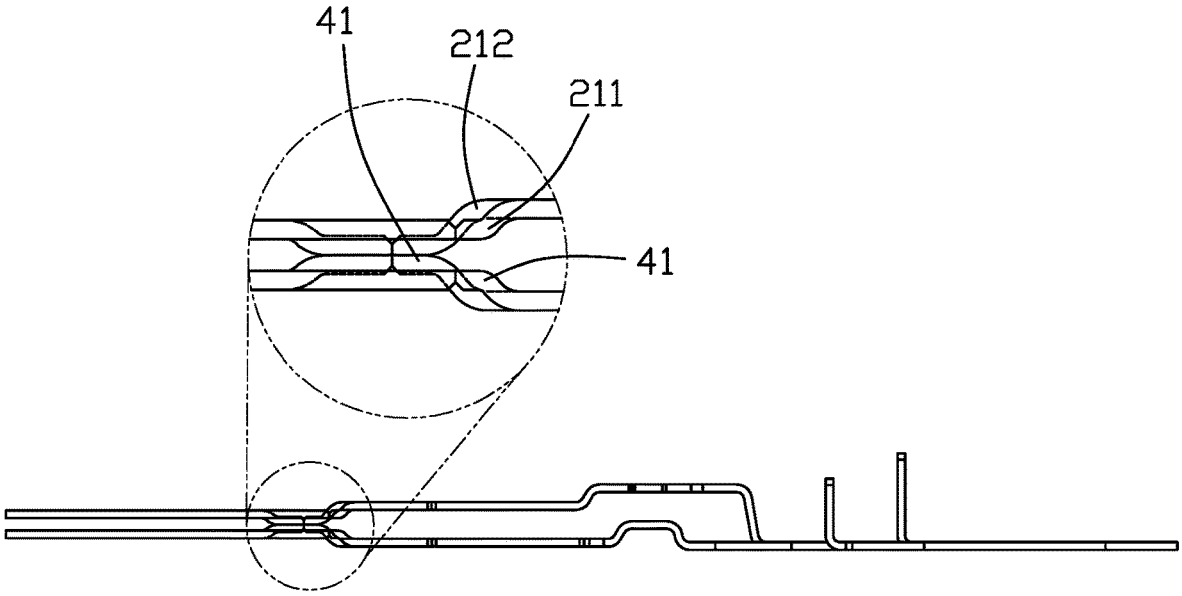
FIG. 11 is a cross-sectional view showing an upper power contact and a lower power contact are in touch with each other.
Figure 12:
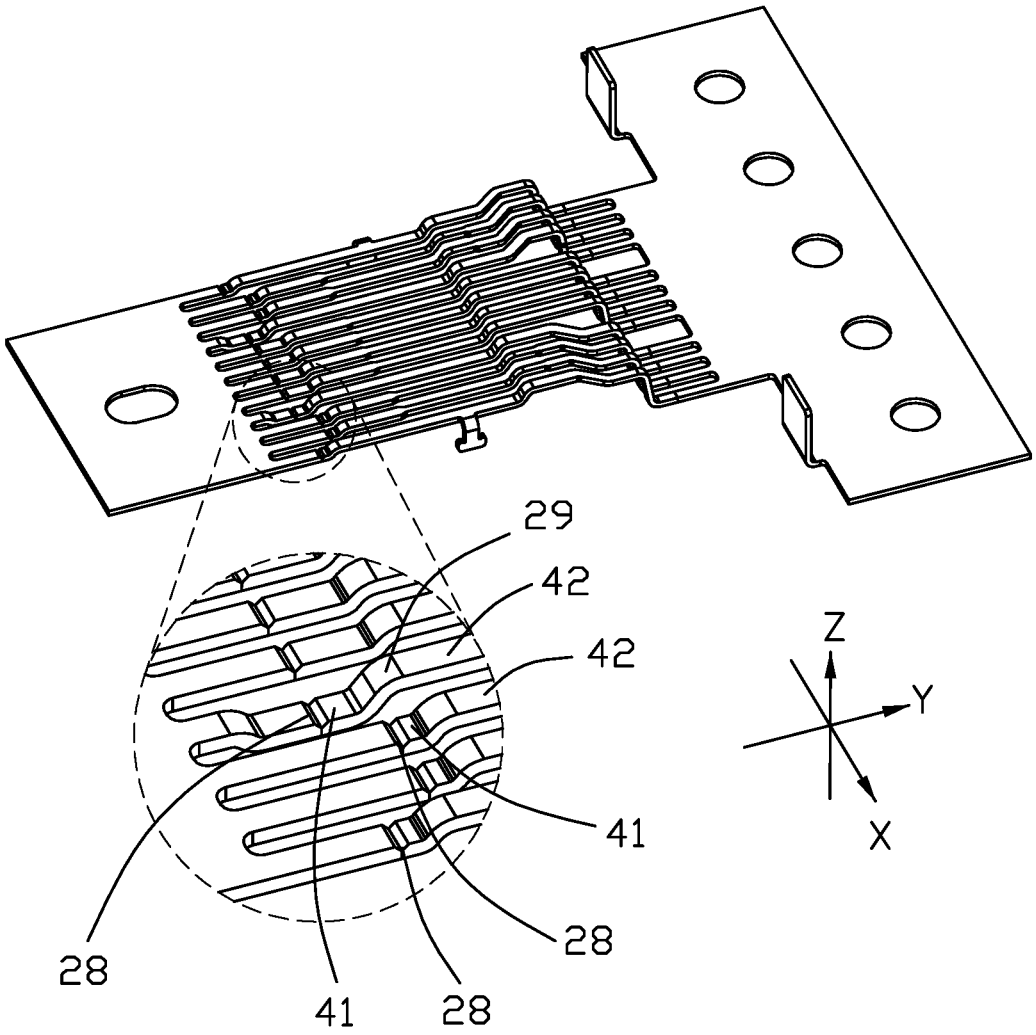
FIG. 12 is a perspective view and a partially enlarged view of the contacts with the primary carrier and the secondary carrier to show the offset of the power contact.

In brief, in the invention there are two rows of contacts spaced from each other in the vertical direction Z, and the contacts in each row are spaced from one another along the transverse direction X perpendicular to the vertical direction, and each contact extends in the front-to-back direction Y perpendicular to both the vertical direction Z and the transverse direction X. As shown in FIG. 7 in this embodiment there are twelve pairs of contacts spaced from each other in the transverse direction, and the contacts in each pair are opposite to each other in the vertical direction wherein each pair of the first pair and the twelfth pair belonging to the signal contacts 211 with farther front ends are spaced from each other in the vertical direction while adapted to be seated upon the shielding plate 3; each pair of second pair, the third pair, the eleventh pair and the tenth pair belonging to the signal contacts 213 with nearer front ends are spaced from each other; each pair of the fourth pair and the ninth pair belonging to the power contacts 212 with the farther front ends with opposite front extensions contacting each other in the vertical direction; each pair of the fifth pair, the sixth pair, the seventh pair and the eighth pair with the farther front ends are space from each other. As shown in FIG. 12, each contact 2 has a V-cut 28 for use with severing the contact 2 from the secondary carrier 6, and an offset section 29 between the contacting portion 42 and the front extension 41. Notably, in each row of the contact 2, the offset 29 of the power contact 212 is essentially aligned with the V-cut 28 of the neighboring signal contact 213 having the nearer front ends. On the other hand, in one row of contacts, the front extension 41 of the power contact 212 is located at a different lever with regard to those of the remaining contacts 2 and closer to the shielding plate in the vertical direction so as to contact that of another power contact 212 of the other row. In addition, in each row, the horizontal front extension 41 of the power contact 212 are offset from the plane of the secondary carrier 6 while those of other contacts 2 are coplanar with the plane of the secondary carrier 6.

What is claimed is:

1. A method of making an electrical connector, comprising the steps of:

forming an upper row of contacts each connected between a primary carrier strip and a secondary carrier strip and stamping a selected one of the upper contacts to have a front extension thereof leveled at a lowest position;

insert-molding the upper row of contacts with an upper insulator to form an upper terminal module unit;

forming a lower row of contacts each connected between another primary carrier strip and another secondary carrier strip and stamping a selected one of the lower contacts to have a front extension thereof leveled at a highest position;

insert-molding the lower row of contacts with a lower insulator to form a lower terminal module unit;

bringing the front extensions of the selected upper and lower contacts to be in touch along an up-to-down direction with each other;

severing the primary and secondary carrier strips connected with the upper row of contacts and the primary and secondary carrier strips connected with the lower row of contacts; and over-molding the upper terminal module unit and the lower terminal module unit with an over-mold.

2. The method as claimed in claim 1, wherein the step of bringing comprises sandwiching a middle shielding plate between the upper terminal module unit and the lower terminal module unit.

3. The method as claimed in claim 2, wherein the front extension of the selected one of the upper contacts is closer to the middle shielding plate in the up-to-down direction than a contacting portion of the selected one of the upper contacts, and he front extension of the selected one of the lower contacts is closer to the middle shielding plate in the upper-to-down direction than a contacting portion of the selected one of the lower contacts.

4. The method as claimed in claim 1, wherein the front extension is offset from a plane defined by the corresponding secondary carrier.

5. The method as claimed in claim 1, wherein the selected one of the upper contacts is a power contact, and the selected one of the lower contacts is another power contact.

6. A method of making an electrical connector, comprising the steps of:

forming an upper row of contacts each connected between a rear primary carrier strip and a front secondary carrier strip in a front-to-back direction, and stamping a selected one of the upper contacts to have a front extension thereof leveled at a lowest position in a vertical direction perpendicular to the front-to-back direction;

insert-molding the upper row of contacts with an upper insulator to form an upper terminal module unit;

forming a lower row of contacts each connected between another rear primary carrier strip and another front secondary carrier strip and stamping a selected one of the lower contacts to have another front extension thereof leveled at a highest position in said vertical direction;

insert-molding the lower row of contacts with a lower insulator to form a lower terminal module unit;

bringing the front extension of the selected one of the upper contacts and said another front extension of the selected one of the lower contacts to be in touch with each other in the vertical direction in a stacked manner.

7. The method as claimed in claim 6, further including a step of severing the rear primary carrier strip and the front secondary carrier strip both originally connected with the upper row of contacts, and severing said another rear primary carrier strip and said another front secondary carrier strip both originally connected with the lower row of contacts.

8. The method as claimed in claim 7, further including a step of over-molding the upper terminal module unit and the lower terminal module unit with an over-mold.

9. The method as claimed in claim 7, wherein a V-cut is formed in the front extension for severing the front secondary carrier strip from the selected one of the upper contacts, and another V-cut is formed in said another front extension for severing said another secondary carrier strip from the selected one of the lower contacts.

10. The method as claimed in claim 9, wherein the selected one of the upper contacts includes an oblique offset adjacent to the front extension, and said offset is aligned with a V-cut of a neighboring upper contact in a transverse direction perpendicular to both the front-to-back direction and the vertical direction.

11. The method as claimed in claim 6, wherein the step of bringing the front extension of the selected one of said upper contacts and the another front extension of the selected one of said lower contacts to be in touch with each other in said vertical direction comprises sandwiching a middle shielding plate between the upper terminal module unit and the lower terminal module unit.

12. The method as claimed in claim 11, wherein the front extension of the selected one of the upper contacts is closer to a level defined by the middle shielding plate in the vertical direction than a contacting portion thereof, and said another front extension of the selected one of the lower contacts is closer to the level defined by the middle shielding plate in the vertical direction than another contacting portion thereof.

13. A method of making an electrical connector, comprising the steps of:

forming an upper row of contacts each connected between a rear primary carrier strip and a front secondary carrier strip in a front-to-back direction, and stamping a selected one of the upper contacts to have a front extension thereof downwardly offset from a plane defined by the secondary carrier strip;

insert-molding the upper row of contacts with an upper insulator to form an upper terminal module unit;

forming a lower row of contacts each connected between another rear primary carrier strip and another front secondary carrier strip and stamping a selected one of the lower contacts to have another front extension thereof upwardly offset from another plane defined by said another front secondary carrier strip;

insert-molding the lower row of contacts with a lower insulator to form a lower terminal module unit; and bringing the front extension of the selected one of said upper contacts and the another front extension of the selected one of said lower contacts to be in touch and stacked with each other in a vertical direction perpendicular to the front-to-back direction.

14. The method as claimed in claim 13, further including a step of severing the rear primary carrier strip and the front secondary carrier strip both originally connected with the upper row of contacts, and severing said another rear primary carrier strip and said another front secondary carrier strip both originally connected with the lower row of contacts.

15. The method as claimed in claim 14, further including a step of over-molding the upper terminal module unit and the lower terminal module unit with an over-mold.

16. The method as claimed in claim 14, wherein a V-cut is formed in the front extension for severing the front secondary carrier strip from the selected one of the upper contacts, and another V-cut is formed in said another front extension for severing said another secondary carrier strip from the selected one of the lower contacts.

17. The method as claimed in claim 16, wherein the selected one of the upper contacts includes an oblique offset adjacent to the front extension, and said offset is aligned with a V-cut of a neighboring upper contact in a transverse direction perpendicular to both the front-to-back direction and the vertical direction.

18. The method as claimed in claim 13, wherein the step of bringing the front extension of the selected one of said upper contacts and the another front extension of the selected one of said lower contacts to be in touch with each other in said vertical direction is done by assembling the upper terminal module unit and the lower terminal module unit together in the vertical direction.

19. The method as claimed in claim 13, wherein the step of bringing the front extension of the selected one of said upper contacts and the another front extension of the selected one of said lower contacts to be in touch with each other in said vertical direction comprises sandwiching a middle shielding plate between the upper terminal module unit and the lower terminal module unit.

20. The method as claimed in claim 19, wherein the front extension of the selected one of the upper contacts is closer to a level defined by the middle shielding plate in the vertical direction than a contacting portion thereof, and said another front extension of the selected one of the lower contacts is closer to the level defined by the middle shielding plate in the vertical direction than another contacting portion thereof.

* * * * *